US011098528B2

(12) United States Patent
Smith et al.

(10) Patent No.: US 11,098,528 B2
(45) Date of Patent: Aug. 24, 2021

(54) TENSIONER FOR AN ARCHITECTURAL-STRUCTURE COVERING

(71) Applicant: Hunter Douglas, Inc., Pearl River, NY (US)

(72) Inventors: Stephen P. Smith, Sandy Springs, GA (US); Michael True, Thornton, CO (US); Jeffrey L. Spray, Erie, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 35 days.

(21) Appl. No.: 16/441,203

(22) Filed: Jun. 14, 2019

(65) Prior Publication Data

US 2019/0383092 A1 Dec. 19, 2019

Related U.S. Application Data

(60) Provisional application No. 62/686,851, filed on Jun. 19, 2018.

(51) Int. Cl.
*E06B 9/324* (2006.01)
*E06B 9/80* (2006.01)

(52) U.S. Cl.
CPC ..... *E06B 9/324* (2013.01); *E06B 9/80* (2013.01); *E06B 2009/801* (2013.01)

(58) Field of Classification Search
CPC . E06B 9/324; E06B 9/80; E06B 9/326; E06B 2009/801
See application file for complete search history.

(56) References Cited

U.S. PATENT DOCUMENTS 120,971 A * 11/1871 Hoffmeister, Jr. ..... E06B 9/50 160/298
3,123,351 A * 3/1964 Graber ..... A47H 3/08 267/71

(Continued)

FOREIGN PATENT DOCUMENTS

EP 2565362 A1 3/2013
EP 2216485 B1 8/2014
EP 1783318 B1 8/2015

OTHER PUBLICATIONS

Author Unknown, "Installing the Universal Cord Tension Device"—YouTube—Rowley Company, LLC—published Jan. 20, 2012, 4 pages.

(Continued)

*Primary Examiner* — Robert Sandy
*Assistant Examiner* — Rowland Do
(74) *Attorney, Agent, or Firm* — Kacvinsky Daisak Bluni PLLC

(57) ABSTRACT

A tensioner for use with an architectural-structure covering including an operating element (e.g., a cord, a chain, or the like) is disclosed. The tensioner selectively securing a position of the operating element relative to the tensioner. In one embodiment, the tensioner includes a body, a slider, a bearing, and an optional biasing member. The body may include a first body member coupled to a second body member. The slider is movably positioned within the body between first and second positions to selectively enable movement of the operating element relative to the tensioner. The bearing includes a projection for coupling to the second body member to prevent the second body member from being decoupled from the first body member. In this manner, when the bearing is enclosed within the body, a user cannot (Continued)

readily open the body (e.g., a user cannot readily separate the first and second body members).

23 Claims, 10 Drawing Sheets

(56) References Cited

U.S. PATENT DOCUMENTS

| | | | | |
|---|---|---|---|---|
| 5,242,006 | A | 9/1993 | Ortega | |
| 5,553,650 | A | 9/1996 | Jelic | |
| 5,752,558 | A * | 5/1998 | Lin | E06B 9/326 16/219 |
| 5,845,696 | A * | 12/1998 | Chou | E06B 9/36 160/178.1 V |
| 6,749,000 | B2 | 6/2004 | Bohlen | |
| 6,792,999 | B2 | 9/2004 | Cross et al. | |
| 7,108,038 | B2 | 9/2006 | Welfonder | |
| 7,114,544 | B2 | 10/2006 | Rice et al. | |
| 8,286,686 | B2 | 10/2012 | Cannaverde | |
| 8,376,022 | B2 | 2/2013 | Lin | |
| 8,539,645 | B2 | 9/2013 | Marocco | |
| 8,850,668 | B2 | 10/2014 | Chen | |
| 8,935,832 | B2 | 1/2015 | Chuang | |
| 9,359,815 | B2 | 6/2016 | Nicolosi | |
| 10,006,245 | B1 * | 6/2018 | Marocco | E06B 9/326 |
| 2008/0251622 | A1 | 10/2008 | Randall et al. | |
| 2016/0168907 | A1 | 6/2016 | Byun | |
| 2017/0145742 | A1 | 5/2017 | Hendriks | |

OTHER PUBLICATIONS

Author Unknown, "Instructions for Universal Drive Tension Device" © 2011 Rowley Company, LLC—2 pages.

Author Unknown, Universal Cord Tension Device—Etsy—Roman Shape Supplies—22-CT70-C—Home Sewing Depot—retrieved Feb. 28, 2018.

Author Unknown, "Universal Cord Tension Installation Instructions"—Fix My Blinds—retrieved Feb. 28, 2018, 3 pages.

Author Unknown, "How to Install a Universal Cord Loop Tensioner" YouTube—FixMyBlinds—published Aug. 15, 2013, 4 pages.

* cited by examiner

TENSIONER FOR AN ARCHITECTURAL-STRUCTURE COVERING

CROSS-REFERENCE TO RELATED APPLICATIONS

This is a non-provisional of, and claims the benefit of the filing date of, U.S. provisional patent application No. 62/686,851, filed Jun. 19, 2018, titled "Tensioner for an Architectural-Structure Covering", the entirety of which application is incorporated by reference herein.

FIELD OF THE DISCLOSURE

The present disclosure relates generally to architectural-structure coverings, and more particularly to a tensioner for mounting a lower extent of an endless or looped operating element (e.g., cord, chain, or the like) used to operate the covering.

BACKGROUND OF THE DISCLOSURE

Architectural-structure coverings for architectural openings and/or structures (used interchangeably herein without the intent to limit), such as windows, doors, archways, portions of a wall, and the like, have taken numerous forms for many years. Architectural-structure coverings may take many different forms. For example, roller blinds, vertical blinds, wooded blinds, Roman shades, etc. One known architectural-structure covering includes a covering such as a fabric that is movable between an extended position and a retracted position. For example, vertically extendable or retractable (e.g., able to be lowered or raised, respectively, in a vertical direction) between an extended position and a retracted position for obscuring and exposing the underlying architectural structure. To move the covering between the extended and retracted positions, some architectural-structure coverings include a rotatable member (e.g., a roller) about which the covering may be wrapped to retract the covering (e.g., the retracted position), and unwrapped to extend the covering (e.g., the extended position). In use, rotation of the rotatable member in a first direction may retract the covering while rotation of the rotatable member in a second, opposite direction may extend the covering.

The architectural-structural covering may also include an operating system operably coupled to the rotatable member and one or more operating elements, such as, for example, a cord or chain, associated with the operating system to move the covering between the retracted position and the extended position. The operating element may hang from, for example, the operating system in an endless loop so that one run of the depending endless loop can be pulled downwardly while the other run moves upwardly to operate the covering.

However, incorporation of corded operating elements may raise concerns. For example, it has been found desirable with corded operating elements that mounting, securing or anchoring the lower extent of the corded operating element adjacent the bottom of the architectural structure makes the covering easier to operate and is aesthetically more attractive as there are no dangling elements but rather suitably tensioned elements confined between the operating system and an anchor at the bottom of the architectural structure. Anchors at the bottom of the architectural structure are sometimes referred to as tensioners as they typically hold the corded operating element in a desirably taut condition. That is, in use, the bottom extent of the operating element is mounted to an adjacent structure (e.g., a window frame or the like) via a tensioner. In use, the tensioner may be mounted to the adjacent structure in an unlocked configuration. The tensioner is also mounted so that the operating element is held in a taut condition. In this configuration, the operating element may be moved relative to the tensioner to move the covering between the extended and retracted positions. However, in use, if the tensioner is decoupled from the adjacent structure (e.g., the tensioner is no longer mounted), the tensioner is biased to a locked configuration to prevent the operating element from moving relative to the tensioner. In this manner, for the operating element to function properly (e.g., to move the covering between the extended and retracted positions), the tensioner is mounted to the adjacent structure and the operating element is maintained in a taut condition.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an architectural-structure covering. The architectural-structure covering may include a covering movable between an extended position and a retracted position, an operating system (e.g., a clutch, a gear, a motor, a drive train, a gear train, combinations thereof, etc.) for moving the covering between the extended and retracted positions, and an operating element (e.g., a cord, a chain, or the like) operatively associated with the operating system to move the covering between the extended and retracted positions.

Disclosed herein is also a tensioner for use with the operating element. The tensioner interacts with the operating element so that when the tensioner is in a first or locked position, configuration, or state, the operating element is prevented from moving substantially relative to the tensioner. In a second or unlocked position, configuration, or state, the operating element is freely movable relative to the tensioner. In use, the tensioner is mounted to an adjacent structure in the unlocked configuration with the operating element in a taut condition. In this manner, the operating element is movable relative to the tensioner so that the covering can be moved between the extended and retracted positions. However, if the tensioner is decoupled from the adjacent structure (e.g., the tensioner is no longer mounted), the tensioner is biased to the locked configuration to prevent the operating element from moving relative to the tensioner.

In one embodiment, the tensioner is adapted and configured so that once assembled (e.g., coupled to the operating element), the body of the tensioner cannot be easily dissembled, thereby preventing accidental disassembly and dislodgment of the various components of the tensioner. That is, in use, once assembled, the tensioner cannot be taken apart readily by a consumer.

Figure 1:
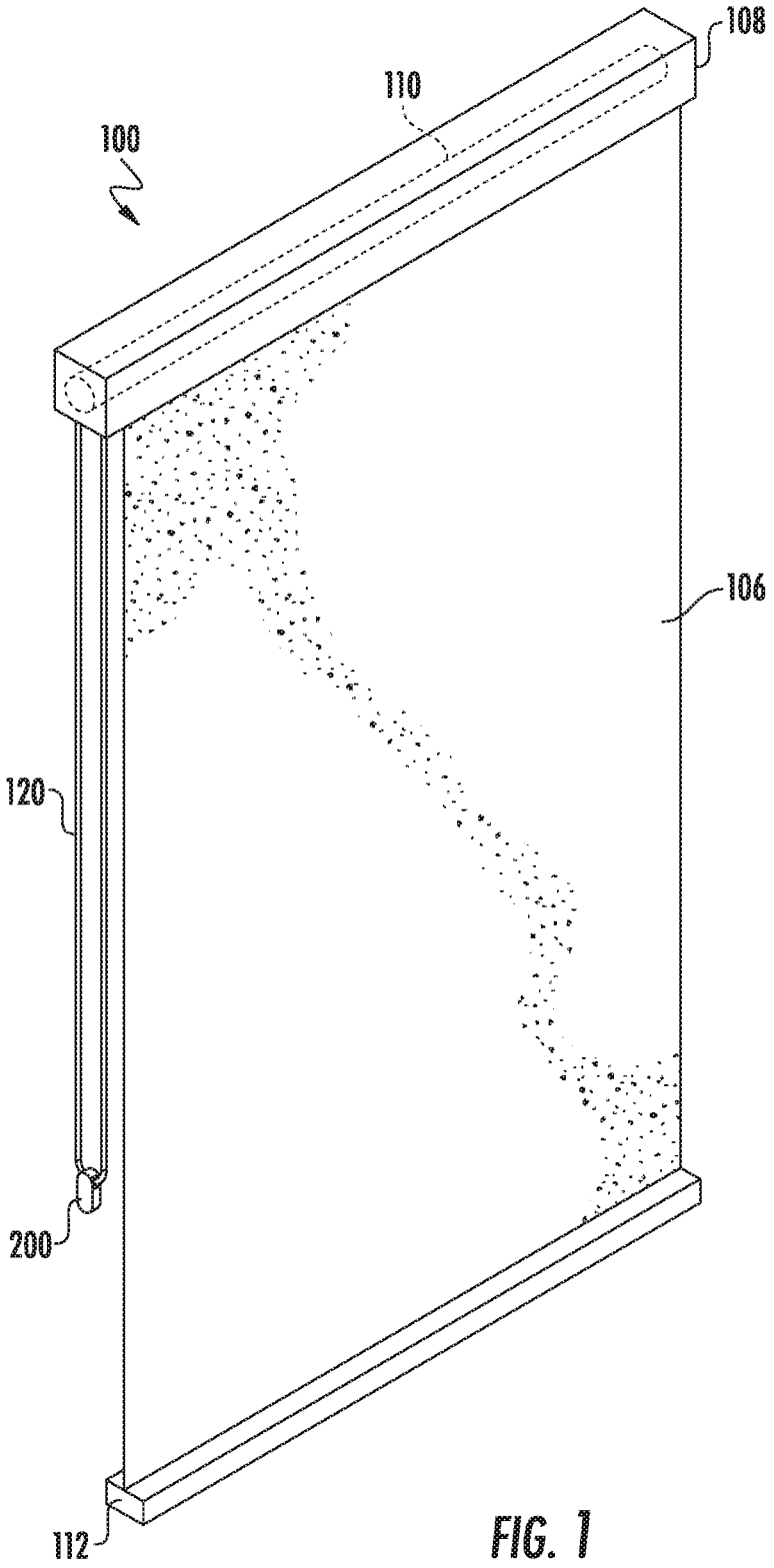
FIG. 1 is a perspective view illustrating an example of an embodiment of an architectural-structure covering including an operating element and a tensioner.

The drawings are not necessarily to scale. The drawings are merely representations, not intended to portray specific parameters of the disclosure. The drawings are intended to depict exemplary embodiments of the disclosure, and therefore are not be considered as limiting in scope. In the drawings, like numbering represents like elements.

DETAILED DESCRIPTION

Embodiments of a tensioner for selectively securing a position of an operating element relative to the tensioner in accordance with the present disclosure will now be described more fully hereinafter with reference to the accompanying drawings, in which embodiments of the present disclosure are presented. As will be described in greater detail below, in one embodiment, the tensioner of the present disclosure is used in connection with an operating element (e.g., a cord, a chain, or the like) of an architectural-structure covering. The tensioner of the present disclosure may, however, be embodied in many different forms and should not be construed as being limited to the embodiments set forth herein. Rather, these embodiments are provided so that this disclosure will convey certain example aspects of the tensioner to those skilled in the art. In the drawings, like numbers refer to like elements throughout unless otherwise noted.

It should be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. For instance, features illustrated or described as part of one embodiment can be used separately, or with another embodiment to yield a still further embodiment. Thus, it is intended that the present subject matter covers such modifications and variations as come within the scope of the appended claims and their equivalents.

As will be described in greater detail herein, in use, the tensioner interacts with an operating element so that when the tensioner is in a first or locked position, configuration, or state (used interchangeably herein without the intent to limit), the operating element is prevented from moving substantially relative to the tensioner, thus preventing the covering from being moved between the extended and retracted positions by operation of the operating element. In a second or unlocked position, configuration, or state, the operating element is freely movable relative to the tensioner so that the covering can be moved between the extended and retracted positions by operation of the operating element.

Additionally, and/or alternatively, in one embodiment, the tensioner is adapted and configured so that once assembled (e.g., coupled to the operating element), the body of the tensioner cannot be easily dissembled, thereby preventing accidental disassembly and dislodgment of the various components of the tensioner.

In one example of an embodiment, a tensioner for use with an architectural-structure covering includes an operating element is disclosed. The tensioner selectively secures a position of the operating element relative to the tensioner. The tensioner including a body having a first body member coupled to a second body member; a slider movably positioned within the body, the slider movable between first and second positions; and a bearing including a projection for coupling to the second body member to prevent the second body member from being decoupled from the first body member. In the first position, the slider presses the operating element against the bearing so that movement of the operating element relative to the body is prevented. In the second position, the slider is retracted from (e.g., slider does not press the operating element against) the bearing so that movement of the operating element relative to the body is permitted.

In one example of an embodiment, a tensioner for use with an architectural-structure covering includes an operating element is disclosed. The tensioner selectively secures a position of the operating element relative to the tensioner. The tensioner including a body having a first body member coupled to a second body member; a slider movably positioned within the body, the slider movable between first and second positions; and a bearing positioned within the body. In the first position, the slider presses the operating element against the bearing so that movement of the operating element relative to the body is prevented. In the second position, the slider is retracted from the bearing so that movement of the operating element relative to the body is permitted. The first and second body members each include a wall portion extending from an inner surface thereof so that when the second body member is coupled to the first body member, a top end of the body includes a closed surface formed by the wall portions for enclosing the bearing within the body.

Referring to FIG. 1, an example of an embodiment of an architectural-structure covering 100 that may be used in accordance with the present disclosure is illustrated. The architectural-structure covering 100 may include a covering 106 movable between an extended position and a retracted position, an operating system (not shown) to move the covering 106 between the extended and retracted positions, and an operating element 120 operatively associated with the operating system to move the covering 106 between the extended and retracted positions.

As illustrated in FIG. 1, in one embodiment, the covering 106 may be a flexible material having an upper edge coupled to a rotatable member 110 and a lower edge. A bottom rail 112 may be coupled to the lower edge of the covering 106. However, it should be understood that the covering 106 may be any suitable covering now known or hereafter developed including, for example, a stacked or tiered covering such as, for example, a Roman shade, a horizontal cellular shade, a horizontal Venetian shade, or the like.

As illustrated, the architectural-structure covering 100 may also include a headrail 108, which may include a housing having opposed end caps (not shown) to form an open-bottom enclosure. The headrail 108 may also include attachments or brackets (not shown) for coupling the headrail 108 to a structure above, or at the top of, an architectural opening, such as a wall, via mechanical fasteners such as screws, bolts, or the like. In use, the headrail 108 may house the rotatable member 110.

Although a particular example of an architectural-structure covering 100 is shown in FIG. 1, many different types and styles of architectural-structure coverings exist and could be employed in place of the examples illustrated in FIG. 1. As such, the present disclosure should not be limited to any particular type of architectural-structure covering.

Referring to FIG. 1, for the sake of convenience and clarity, terms such as "front," "rear," "top," "bottom," "up," "down," "vertical," "horizontal", "inner," and "outer" may be used herein to describe the relative placement and orientation of various components and portions of the architectural-structure covering 100, each with respect to the geometry and orientation of the architectural-structure covering 100 as they appear in FIG. 1. Said terminology is intended to be non-limiting and is used herein merely to describe relationship between various components as illustrated in FIG. 1.

An operating element 120 generally is operatively associated with an operating system (not shown) to move the covering 106 between the extended and retracted positions. The operating system can be any suitable operating system now known or hereafter developed such as, for example, a clutch, a gear, a motor, a drive train, a gear train, combinations thereof, etc. As illustrated, the operating element 120 can be in the form of a continuous loop (e.g., a cord, chain, rope, or the like). The architectural-structure covering 100 also includes a tensioner 200. The tensioner 200 is adapted and configured to receive a portion of the operating element 120. In use, the tensioner 200 is movable between a first configuration and a second configuration. In the first configuration, the operating element 120 is secured relative to the tensioner 200 (e.g., prevented from moving) while in the second configuration, the operating element 120 is freely movable relative to the tensioner 200.

That is, the tensioner 200 may be adapted and configured to enable the operating element 120 to be locked and unlocked against relative movement with respect to the tensioner 200. In the unlocked or second configuration, the operating element 120 is permitted to move sufficiently relative to the tensioner 200 so that the covering 106 can move between the extended and retracted positions. In the locked or first configuration, the operating element 120 is prohibited or prevented from moving sufficiently relative to the tensioner 200. In this manner, with the tensioner 200 in the unlocked configuration and with the tensioner 200 mounted to an adjacent architectural structure, the operating element 120 can be moved relative to the tensioner 200 so that the covering 106 can be moved between the extended and retracted positions. However, in use, if the tensioner 200 is decoupled from the adjacent structure (e.g., the tensioner 200 is no longer mounted), the tensioner 200 is biased to the first or locked configuration to prevent the operating element 120 from moving relative to the tensioner 200. In this manner, for the operating element 120 to function properly (e.g., to move the covering between the extended and retracted positions), the tensioner 200 is mounted to the adjacent structure and the tensioner 200 is maintained in the second or unlocked configuration. Thus arranged, the operating element 120 is maintained in a taut condition.

Figure 2:
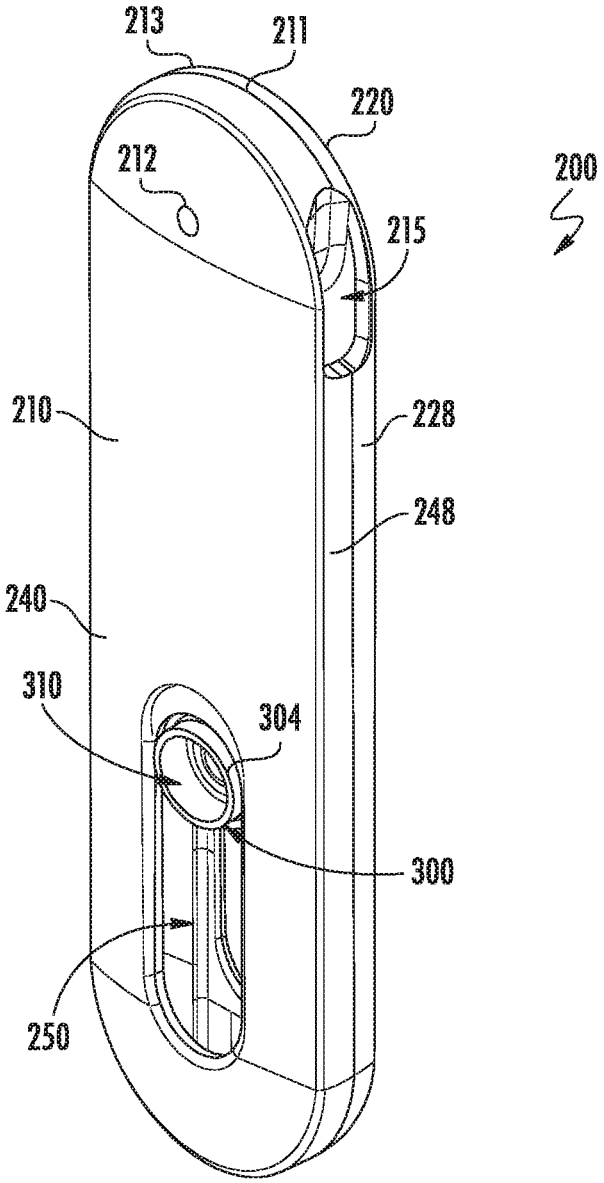
FIG. 2 is a perspective view illustrating an example of an embodiment of a tensioner that may be used in connection with the architectural-structure covering shown in FIG. 1.

Referring to FIG. 2, in one embodiment, as will be described in greater detail, the tensioner 200 may include an elongated slot 250 formed therein for accessing a slider 300 movably positioned within the tensioner 200. In use, the slider 300 may be moved from a first position to a second position such that the slider 300 no longer contacts the operating element 120, thereby permitting the operating element 120 to move relative to the tensioner 200.

Additionally, in use, the tensioner 200 is mounted to an adjacent structure (e.g., a window frame or the like). In use, one or more fasteners, such as a screw, a nail, a bolt, or the like, may be used to mount the tensioner 200 to a wall or other structure. That is, for example, in the illustrated embodiment of FIG. 2, a fastener (not shown) may be inserted through a portion or opening 310 formed in the slider 300 and the elongated slot 250 for mounting the tensioner 200 to the adjacent structure. In use, the tensioner 200 may be mounted to the adjacent structure with the slider 300 in the second position (e.g., the slider 300 is positioned such that it does not contact the operating element 120).

In this configuration, the tensioner 200 is mounted to the adjacent structure with the operating element 120 in a taut condition. As such, with the operating element 120 in a taut condition and with the slider 300 in the second position, the operating element 120 is free to move relative to the tensioner 200 so that the covering 106 can be moved between the extended and retracted positions. However, in use, if the tensioner 200 is decoupled from the adjacent structure (e.g., the tensioner 200 is no longer mounted to the adjacent structure), the slider 300 is biased to the first position (e.g., the slider 300 moves into contact with the operating element 120) to prevent the operating element 120 from moving relative to the slider 300 and hence the tensioner 200. Referring to the illustrated embodiment in FIGS. 2-4, the tensioner 200 includes a housing or body 210 (used interchangeably herein without the intent to limit). The body 210 includes first and second body members 220, 240. The tensioner 200 also includes a slider 300 movably positioned within the body 210, a biasing member 350 for biasing the slider 300 in the first position, and a bearing 400. As will be described in greater detail, in the first position, the slider 300 is adapted and configured to operate in conjunction with the bearing 400 to press the operating element 120 between the slider 300 and the bearing 400 to lock a position of the operating element 120 between the bearing 400 and the slider 300.

In accordance with one aspect of the present disclosure, the bearing 400 is adapted and configured so that when the tensioner 200 is assembled (e.g., when the bearing 400 is positioned within the body 210 and the first and second body members 220, 240 are coupled to each other), the first and second body members 220, 240 cannot be easy disassembled thereby preventing unintentional dislodgement of the various components. That is, in one embodiment, the tensioner 200 is adapted and configured to prevent the second body member 240 from being decoupled from the first body member 220 so that, once assembled, the tensioner 200 cannot be easily disassembled, thereby preventing the components, such as, for example, the bearing 400, from falling out. That is, as will be described in greater detail below, in one example, the body 210 of the tensioner 200 is arranged and configured to enclose the bearing 400 thereby rendering the bearing 400 inaccessible to prevent accidental dislodgement of the bearing 400 from the tensioner 200. In addition, the tensioner 200 is arranged and configured to prevent the second body member 240 from moving relative to the first body member 220 to prevent accidental decoupling of the tensioner 200 (e.g., the tensioner 200 is arranged and configured to prevent the second body member 240 from moving relative to the first body member 220 in the opposite direction to which they are coupled to each other to prevent accidental disengagement and dislodgement of, for example, the bearing 400). Referring to the illustrated embodiment in FIGS. 2-4, the first and second body members 220, 240 are coupled to each other by any suitable mechanism now known or hereafter developed such as, for example, an adhesive, fasteners, etc. In the illustrated embodiment, the first and second body members 220, 240 may include a plurality of interconnecting projections and recesses 222, 242 so that the first and second body members 220, 240 can be coupled together. In the illustrated embodiment, the first and second body members 220, 240 may be in slidable engagement with each other. In addition, the interaction between the plurality of interconnecting projections and recesses 222, 242 keep the first and second body members 220, 240 from being pulled apart.

Figure 3:
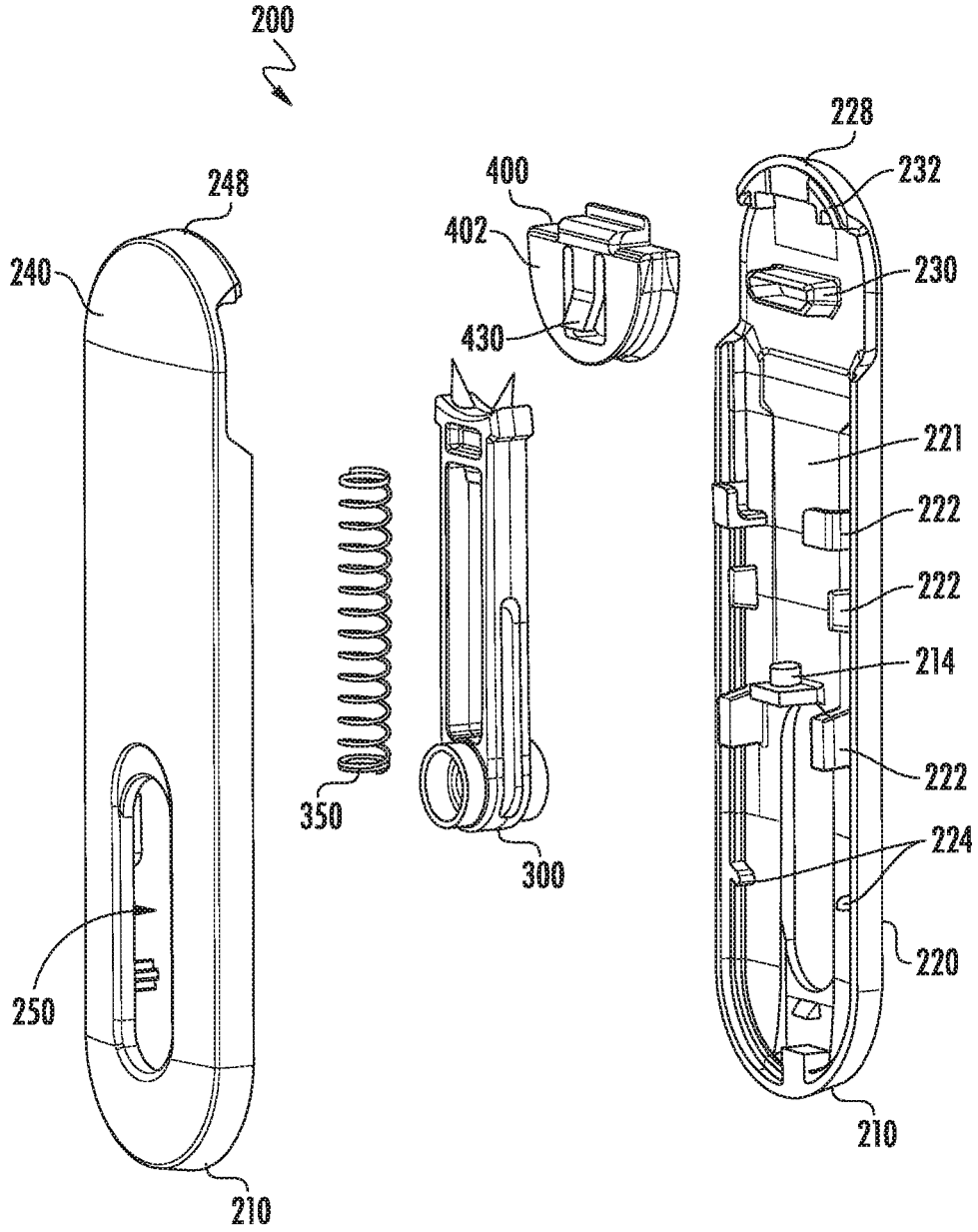
FIG. 3 is an exploded, front perspective view of the tensioner shown in FIG. 2.
Figure 4:
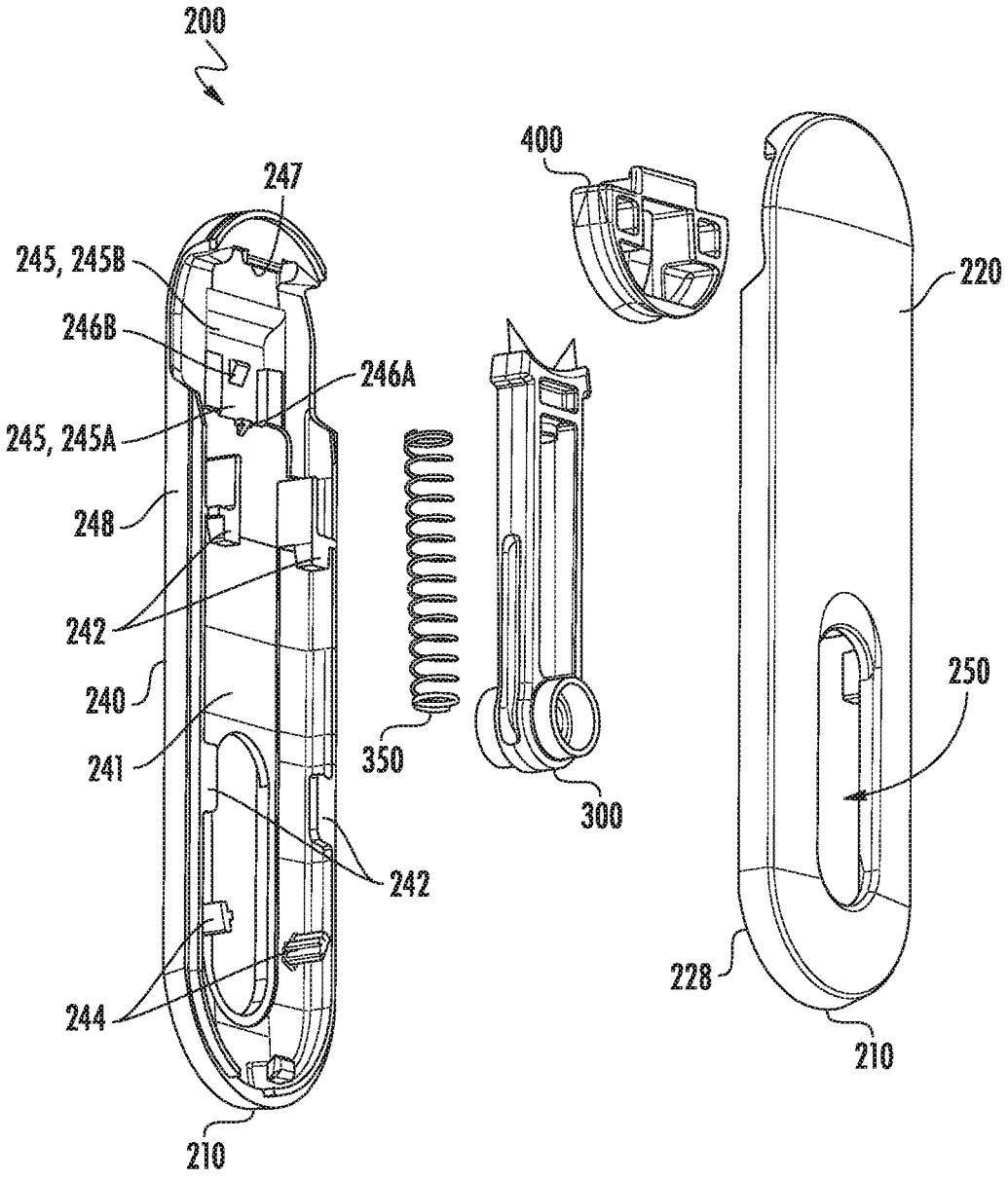
FIG. 4 is an exploded, rear perspective view of the tensioner shown in FIG. 2.
Figure 5:
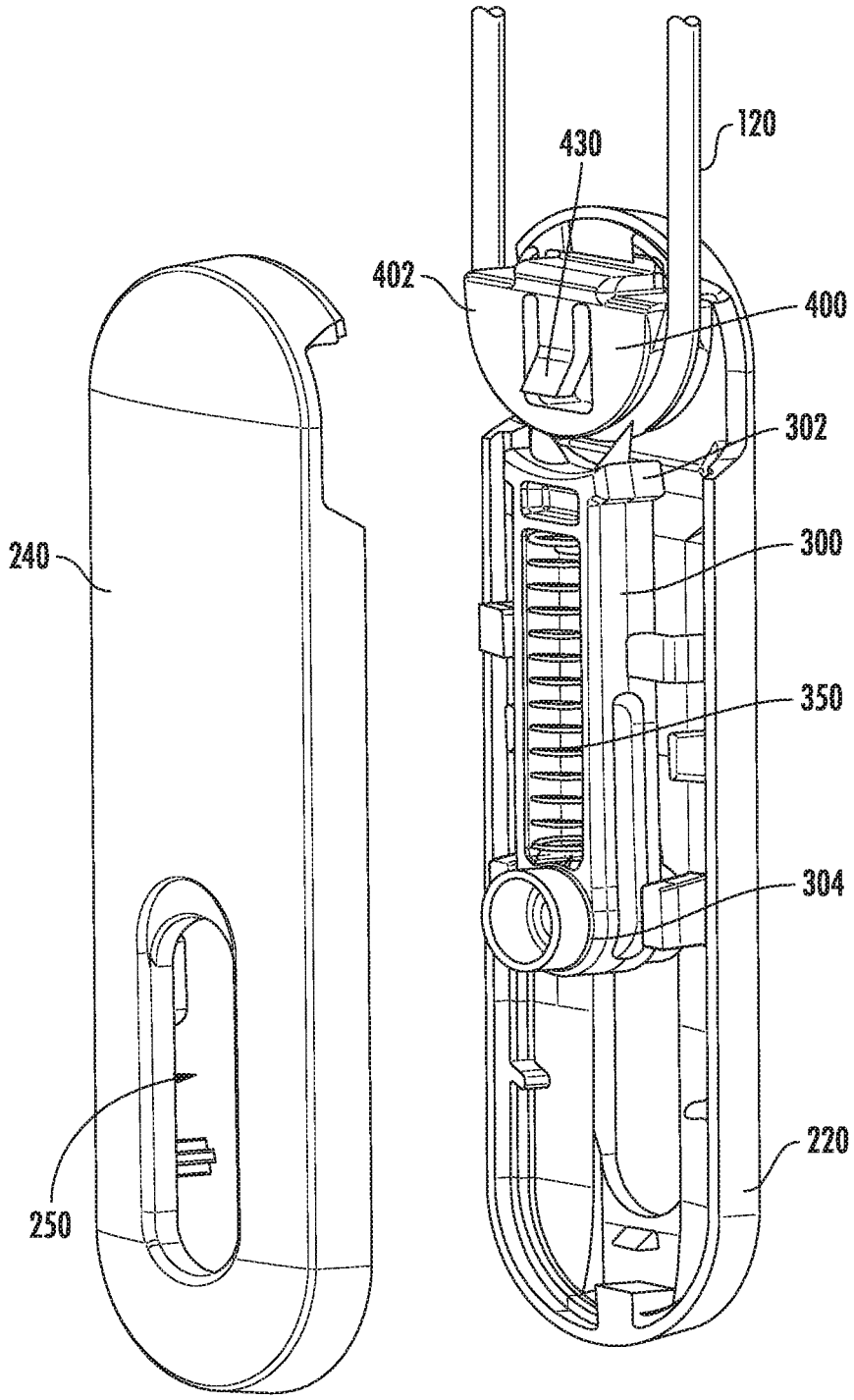
FIG. 5 is a partially exploded perspective view of the tensioner shown in FIG. 2, the slider shown in a first position.

In addition, referring to FIG. 3, the first body member 220 may include a plurality of catches 224 for interacting with a plurality of catches 244 formed on the upper body member 240 (FIG. 4). In use, the catches 224, 244 prevent, or at least minimize, the risk that the first and second body members 220, 240 can be decoupled by bending. That is, the interaction between the catches 224, 244 prevent, or at least minimize, the risk that the first and second body members 220, 240 can be slide apart. Thus arranged, the plurality of interconnecting projections and recesses 222, 242 formed on the first and second body members 220, 240, the interaction between the catches 224, 244 formed on the first and second body members 220, 240, and the interaction between a projection 430 formed on a bearing 400 and latches 246 (FIG. 4) formed on an inner surface 241 of the second body member 240 prevent, or at least minimize, separation between the first and second body members 220, 240 thereby preventing the bearing 400 from decoupling from the body 210 (e.g., preventing a recess 409 formed on the bearing from disengaging from a projection 247 formed on the second body member 240 and/or preventing the decoupling from the interconnecting projections and recesses 222, 242).

Figure 6:
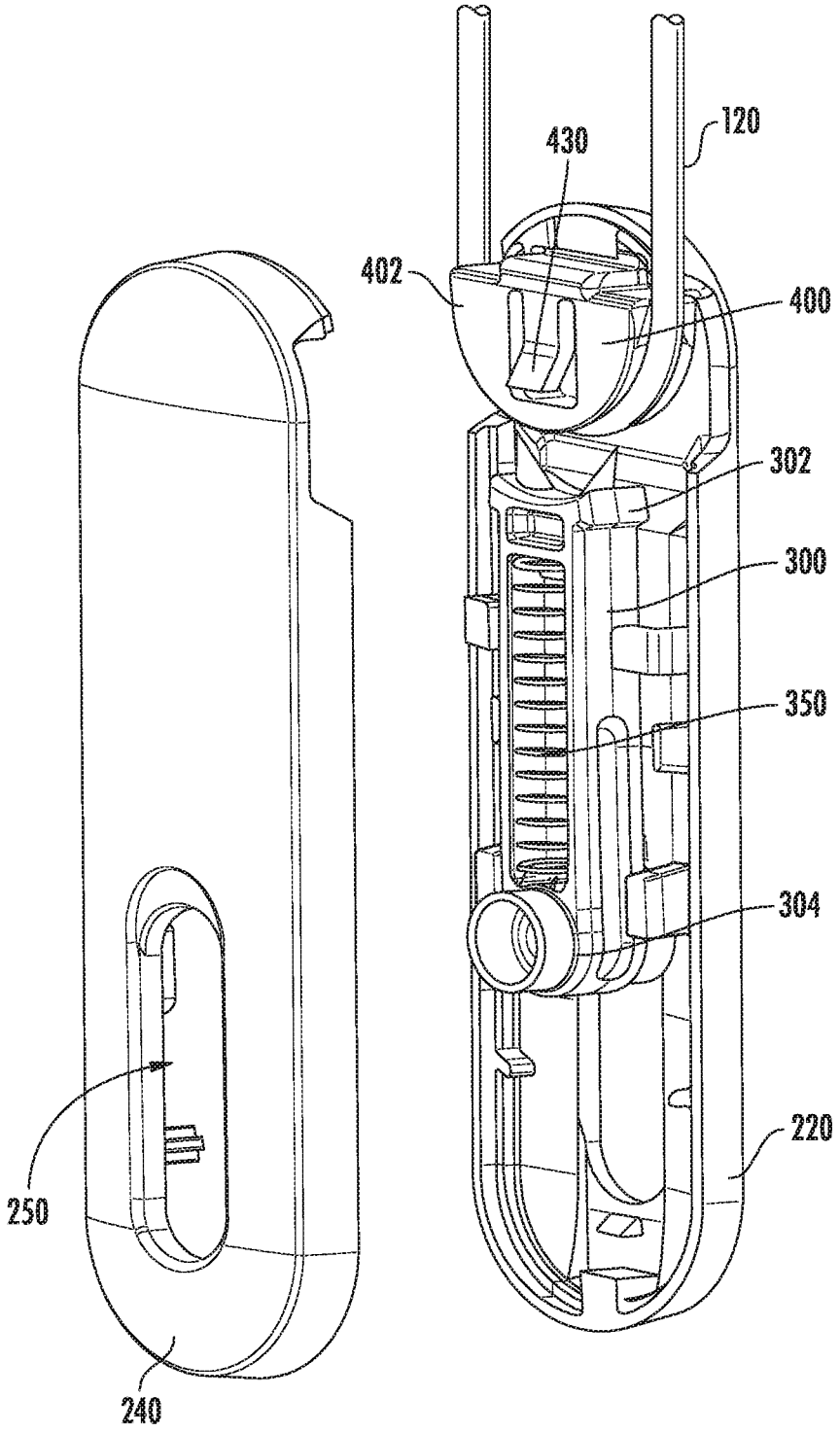
FIG. 6 is a partially exploded perspective view of the tensioner shown in FIG. 2, the slider shown in a second position.

Referring to FIGS. 3-6, in the illustrated embodiment, the slider 300 is movable between a first position (illustrated in FIG. 5) and a second position (illustrated in FIG. 6). In the first position, the slider 300 is in contact with the operating element 120 so that movement of the operating element 120 relative to the tensioner 200 is prevented. In the second position, the slider 300 is moved relative to body 210 of the tensioner 200 so that the slider 300 is no longer in contact with the operating element 120 thereby enabling the operating element 120 to move relative to the tensioner 200. In one embodiment, the basing member 350 biases the slider 300 into the first position and thus into contact with the operating element 120.

Figure 7:
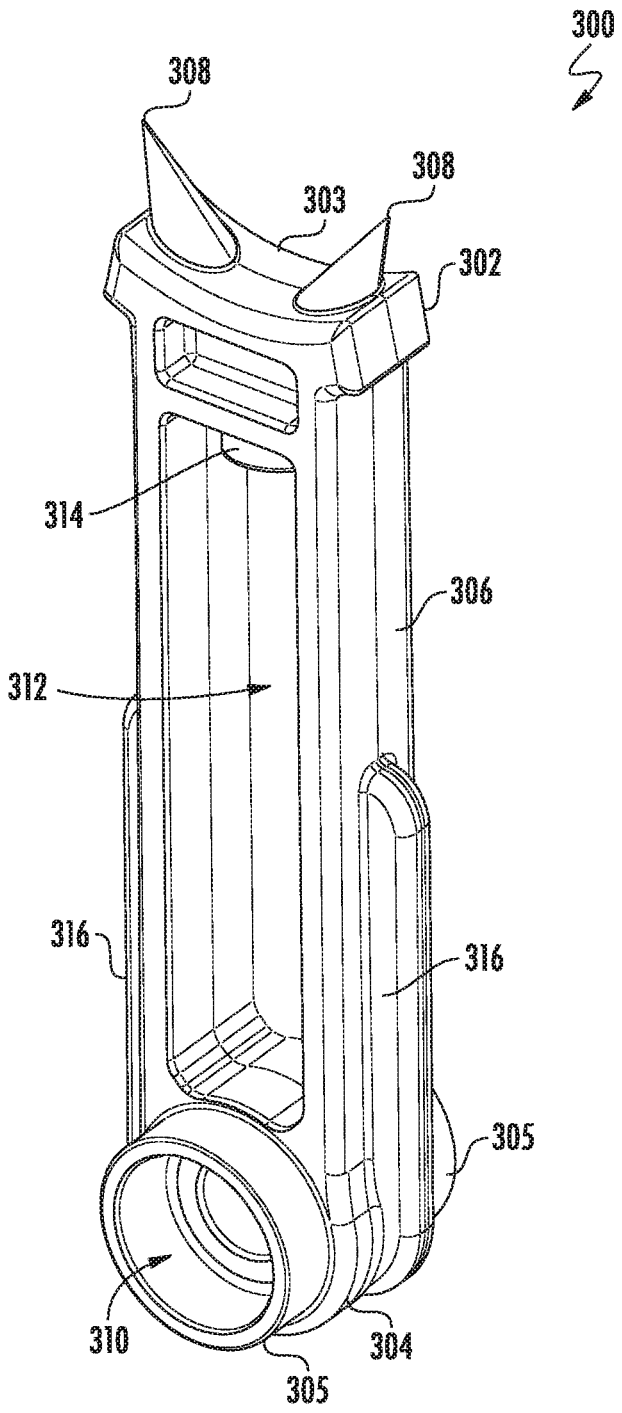
FIG. 7 is a perspective view of an example of an embodiment of a slider that may be used in connection with the tensioner shown in FIG. 2.

Referring to FIG. 7, in the illustrated embodiment, the slider 300 includes a first end 302, a second end 304, and an intermediate portion 306 extending between the first and second ends 302, 304. In use, the first end 302 of the slider 300 is adapted and configured for contacting the operating element 120. In the first position, the first end 302 of the slider 300 is adapted and configured to operate in conjunction with the bearing 400 to press the operating element 120 between the slider 300 and the bearing 400 (FIGS. 3-6 and 8-10) to lock a position of the operating element 120 between the bearing 400 and the first end 302 of the slider 300. In the illustrated example, the first end 302 of the slider 300 includes a curved or arcuate surface 303 for contacting the operating element 120. Additionally, and/or alternatively, the first end 302 of the slider 300, in the illustrated example, includes one or more teeth 308 for locking the operating element 120.

As previously mentioned, the second end 304 of the slider 300 is adapted and configured to be accessed via, for example, the elongated slot 250 formed in the body 210 of the tensioner 200. As illustrated, the second end 304 of the slider 300 includes an opening 310 formed therein for receiving a fastener for mounting the tensioner 200 to, for example, an adjacent structure. In this manner, with the first end 302 of the slider 300 (e.g., teeth 308) in contact with the operating element 120, a user may initially (e.g., during mounting) move the slider 300 from the first position to the second position against the biasing force of the biasing member 350. As illustrated, the second end 304 of the slider 300 includes an outwardly extending ledge 305 for positioning within the elongated slot 250 formed in the body 210. In use, the ledge 305 may project through the elongated slot 250 formed in the body 210 so that the user can initially contact the second end 304 of the slider 300 for moving the slider 300 between the first and second positions. Thereafter, the second end 304 of the slider 300 may be mounted to the adjacent structure with the slider 300 in the second position so that the first end 302 of the slider 300 (e.g., teeth 308) is not in contact with the operating element 120.

As previously mentioned, the slider 300 may be biased towards the first position so that the first end 302 of the slider 300 presses the operating element 120 against the bearing 400 to prevent the operating element 120 from moving relative to the tensioner 200. As such, in use, when mounted, the tensioner 200 is positioned so that the slider 300 is in the second position so that the first end 302 of the slider 300 (e.g., teeth 308) does not press the operating element 120 into the bearing 400. Thus arranged, the tensioner 200 allows the operating element 120 to move relative to the tensioner 200. However, when the tensioner 200 is decoupled from the adjacent structure, the biasing member 350 biases the slider 300 into contact with the operating element 120 so that the operating element 120 is prevented from moving relative to the tensioner 200. The tensioner 200 may be biased towards the first position by any suitable mechanism now known or hereafter developed. As illustrated, in one embodiment, the biasing member 350 is a spring such as, for example, a coil spring, although use of other springs is envisioned. Additionally, the intermediate portion 306 of the slider 300 may include a cavity 312 for receiving the coil spring. In use, the coil spring may be located or positioned within the cavity 312 of the slider 300 between a tab 314 formed on the slider 300 (e.g., tab 314 adjacent to a first end of the cavity 312) and a tab 214 (FIG. 3) formed on an inner surface 221 of the first body member 220 of the tensioner 200.

Additionally, in one embodiment, the slider 300 includes one or more guides 316 for interacting with the first body member 220, such as, for example with corresponding projections 222 (FIG. 3) formed on the inner surface 221 of the first body member 220, for guiding movement of the slider 300 between the first and second positions.

Figure 8:
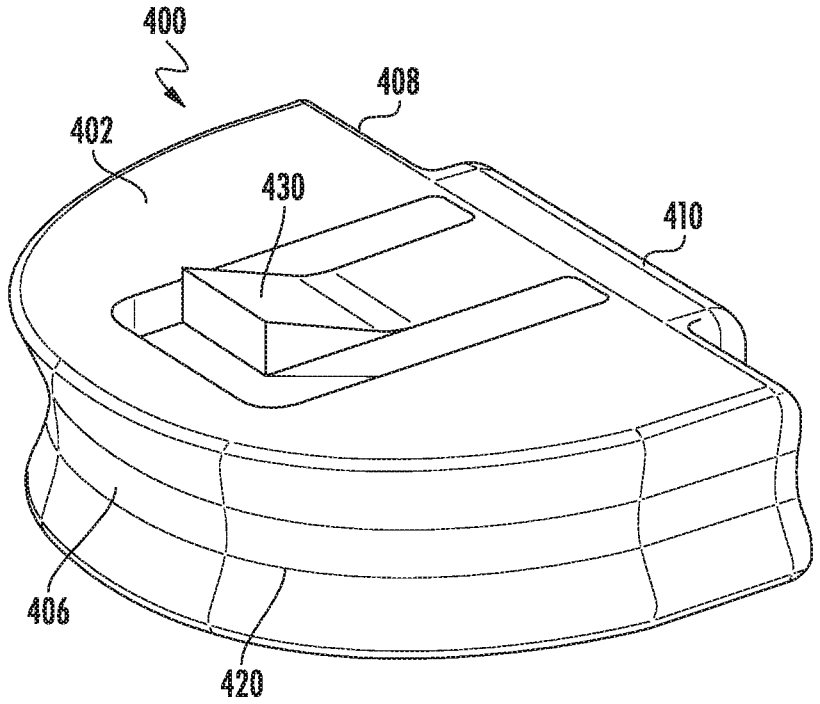
FIG. 8 is a top, front perspective view of an example of an embodiment of a bearing that may be used in connection with the tensioner shown in FIG. 2.
Figure 9:
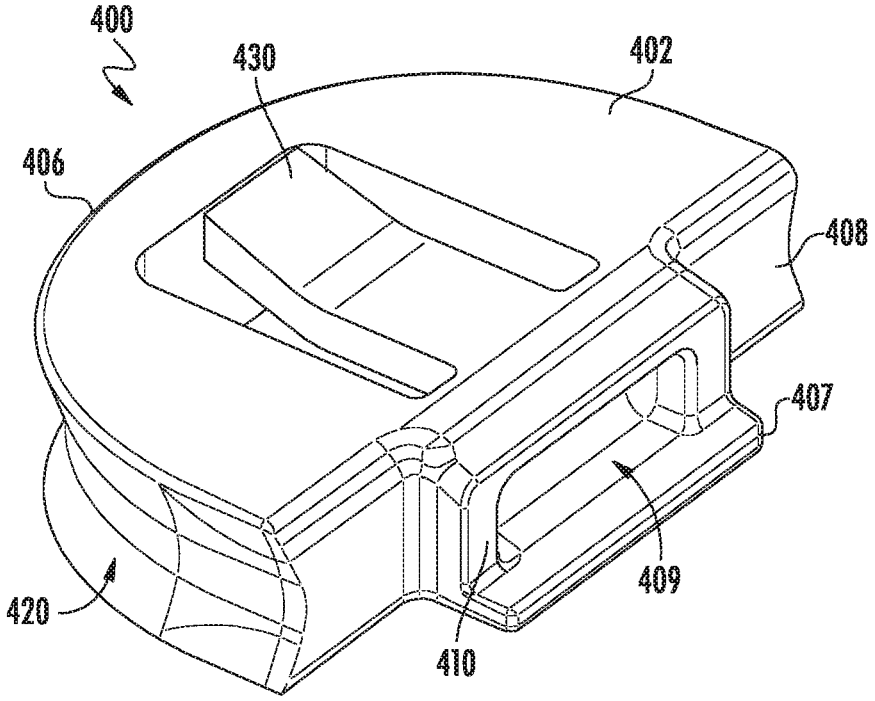
FIG. 9 is a top, rear perspective view of the bearing shown in FIG. 8.
Figure 10:
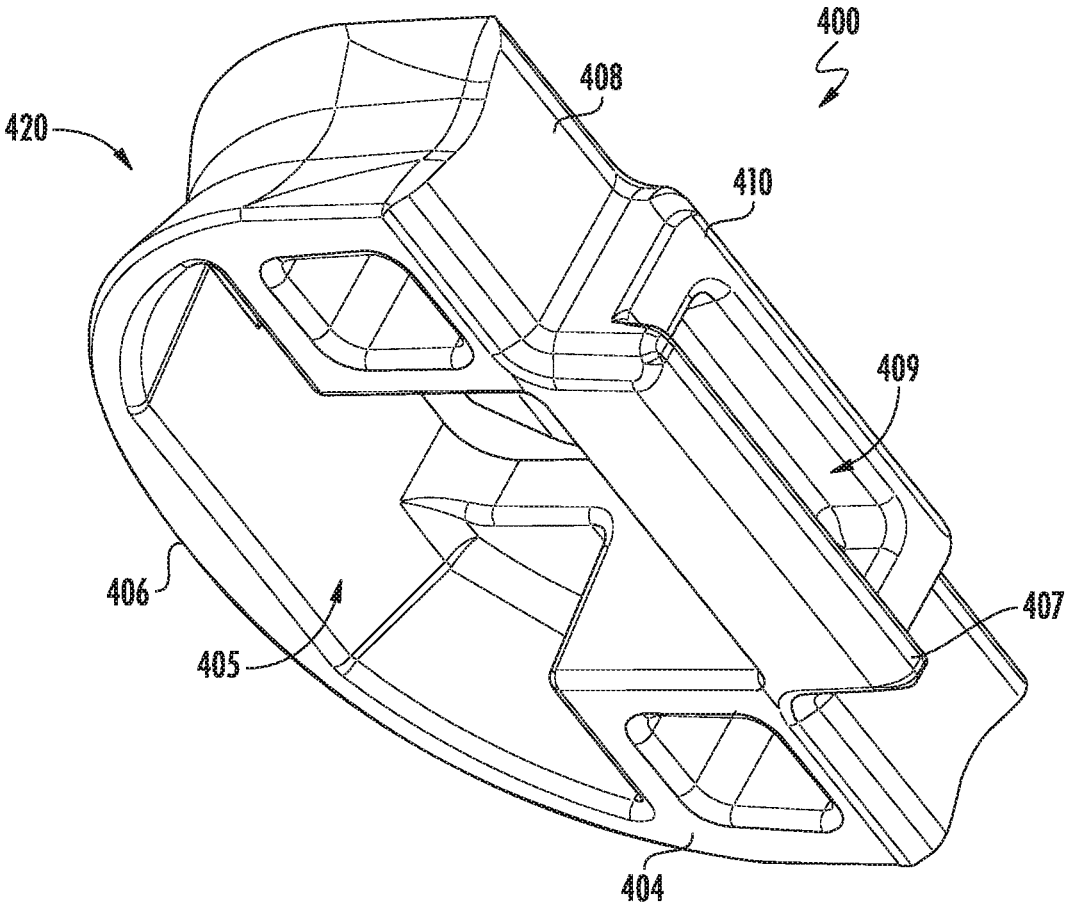
FIG. 10 is a bottom perspective view of the bearing shown in FIG. 8.

Referring to FIGS. 8-10, an example of an embodiment of a bearing 400 is illustrated. In use, the bearing 400 operates in conjunction with the slider 300 to enable or disable the operating element 120 from moving relative to the tensioner 200 depending on the location of the slider 300. That is, as previously mentioned, the slider 300 is movable between first and second positions. In the first position, the operating element 120 is held between the slider 300 and the bearing 400 (e.g., the operating element 120 is pressed in-between the slider 300 and the bearing 400). In this manner, the position of the operating element 120 is fixed or locked relative to the position of the tensioner 200. In the second position, the operating element 120 is permitted to move relative to the tensioner 200 (e.g., the operating element 120 can slide or move relative to the slider 300 and/or the bearing 400).

In the illustrated embodiment, the bearing 400 includes a front surface 402, a back surface 404 (FIG. 10), a bottom end 406, and a top end 408. In use, the bearing 400 is coupled to the body 210 of the tensioner 200. The bearing 400 may be coupled to the body 210 of the tensioner 200 by any suitable mechanism now known or hereafter developed such as, for example, a press-fit, an adhesive, a fastener, etc. As shown, the illustrated embodiment includes a cavity 405 (FIG. 10) formed in the back surface 404 of the bearing 400 for interacting or receiving a projection, a ledge, a stem, or the like (collectively used herein without the intent to limit) 230 (FIG. 3) formed on the body 210 such as, for example, a stem 230 extending from the inner surface 221 of the first body member 220. Alternatively, it is envisioned that the stem and cavity may be reversed, for example, the stem may be formed on the bearing and the recess may be formed on the body. Moreover, it is envisioned that the stem and/or recess may be located on other surfaces of the bearing and body, respectively.

Additionally, and/or alternatively, as shown in the illustrated embodiment of FIG. 9, the top end 408 of the bearing 400 may include a ledge 407 and a recess 409. In use, the ledge 407 is arranged and configured to interact with or receive a projection, ledge, lip, or the like (collectively used herein without the intent to limit) 232 (FIG. 3) formed on the body 210 such as, for example, the first body member 220. The recess 409 is arranged and configured to interact with or receive a projection, ledge, lip, or the like (collectively used herein without the intent to limit) 247 (FIG. 4) formed on the body 210 such as, for example, the second body member 240. As shown, the recess 409 may be formed in a protrusion 410 extending from the top end 408 of the bearing 400. Alternatively, it is envisioned that the recess and lip may be reversed, for example, the lip may be formed on the bearing and the recess may be formed on the body. Moreover, it is envisioned that the lip and/or recess may be located on other surfaces of the bearing and body, respectively.

As shown, in the illustrated embodiment, the bottom end 406 of the bearing 400 includes a groove 420. In use, the groove 420 is adapted and configured to interact with and guide the operating element 120. As illustrated, the bottom end 406 of the bearing 400 may have a curved or arcuate shape and the groove 420 may have a corresponding arcuate shape extending from the top end 408 of the bearing 400.

In use, when the slider 300 is in the first position (FIG. 5), the operating element 120 is secured between the first end 302 of the slider 300 and the bottom end 406 of the bearing 400 (e.g., between the curved surface 303 and teeth 308 formed on the first end 302 of the slider 300 and the groove 420 (e.g., arcuate groove) formed in the bearing 400). In this manner, the position of the operating element 120 is fixed or locked relative to the position of the tensioner 200. Meanwhile, with the slider 300 in the second position, the operating element 120 is permitted to move relative to the tensioner 200 (e.g., the operating element 120 can slide or move within the groove 420 (e.g., arcuate groove) formed in the bearing 400).

Referring to FIGS. 8-10, in the illustrated embodiment, the front surface 402 of the bearing 400 includes a projection 430 for engaging the body 210 such as, for example, for engaging a recess 245 formed in an inner surface 241 (FIG. 4) of the second body member 240. The projection 430 may be provided in any shape or form configured to engage the body 210 when assembled. In the illustrated embodiment, the projection 430 is adapted and configured to engage the second body member 240 to prevent easy disassembly of the tensioner 200 thereby preventing unintentional dislodgement of the various components. That is, in one embodiment, as previously described, the first and second body members 220, 240 may include a plurality of interconnecting projections and recesses 222, 242 so that the first and second body members 220, 240 can be slidably coupled together. The projection 430 formed on and extending from the top surface 402 of the bearing 400 is adapted and configured to prevent the second body member 240 from slidably moving relative to the first body member 220 so that, once assembled, the tensioner 200 cannot be easily disassembled, thereby preventing the components such as, for example, the bearing 400 from falling out. That is, the projection 430 formed on and extending from the top surface 402 of the bearing 400 prevents the second body member 240 from moving in the opposite direction to the original direction in which the second body member 240 was moved to couple to the first body member 220, e.g., if one body member is slid in a first direction with respect to the other body member to close the body 210, then the projection 430 prevents the one body member from sliding in a direction opposite the first direction to open the body 210.

In the illustrated embodiment, the projection 430 may be in the form of a leaf spring. In use, during assembly, the projection (e.g., leaf spring) 430 flexes downwards so that the second body member 240 is slidably movable relative to the first body member 220. However, once properly positioned, the projection (e.g., leaf spring) 430 engages the recess 245 formed in the inner surface 241 (FIG. 4) of the second body member 240 so that further movement of the second body member 240 relative to the first body member 220 (e.g., movement in the opposite direction) is prevented and thus disassembly of the body 210 is prevented.

Optionally, the projection 430 (e.g., leaf spring projection) may be positioned in alignment with an opening 212 (FIG. 2) formed in the body 210 of the tensioner 200 (e.g., second body member 240). In this manner, the user may be able to position an element such as, for example, a paper clip, a pencil, a screwdriver, or the like, through the opening 212 and into contact with the projection 430 (e.g., leaf spring projection) formed on the bearing 400 to thereby compress the projection 430 (e.g., leaf spring projection) so that the second body member 240 can be disengaged from the bearing 400, and thus the first and second body members 220, 240 can be disengaged from each other.

Additionally, and/or alternatively, referring to FIGS. 2-4, the illustrated example of an embodiment of the first and second body members 220, 240 each include a wall portion 228, 248 extending substantially along outer circumferential portions of the first and second body members 220, 240 from an inner surface 221 of the first body member 220 and from an inner surface 241 of the second body member 240, respectively. The circumferential wall portions 228, 248 are adapted and configured to substantially close the side surfaces 211 (FIG. 2) of the body 210 when the first and second body members 220, 240 are coupled to each other. Alternatively, it is envisioned that a single wall portion extending from either of the first and second body members 220, 240 may be provided. That is, a single wall portion 228 extending from the first body member 220 or a single wall portion 248 extending from the second body member 240 may be arranged and configured to substantially close the side surfaces 211 (FIG. 2) of the body 210 when the first and second body members 220, 240 are coupled to each other. In either event, in this manner, the top end 213 of the body 210 (e.g., the portion between the openings 215 (FIG. 2) formed in the body 210 through which the operating element 120 is inserted) is closed about the bearing 400. In this manner, once assembled, the bearing 400 is further enclosed at the top end 213 within the body 210 of the tensioner 200 by the side surfaces 211 (e.g., the body 210 of the tensioner 200 encloses the bearing 400 rendering the bearing 400 inaccessible once the first and second body members 220, 240 are coupled or locked together). This is, in contrast with conventional tensioners that incorporate an open top end for assisting with insertion of a bearing.

In one example method of use, the tensioner 200 may be provided along with an architectural-structure covering 100 or may be sold or supplied separately therefrom. In either event, the tensioner 200 may be provided with the slider 300 and the biasing member 350 coupled to the body 210 of the tensioner 200. The bearing 400 may be supplied separately. In use, the installer, fabricator, etc. (used interchangeably herein) may open the tensioner 200 by separating the first and second body members 220, 240 relative to each other. Thereafter, the fabricator may couple the bearing 400 to the body 210 (e.g., first body member 220) and insert the operating element 120 into the openings 215 (FIG. 2) formed in the body 210 and into the groove 420 formed in the bearing 400. Next the second body member 240 is coupled to the first body member 220 securing the operating element 120 within the body 210 of the tensioner 200 with the second body member 240 securely fixed to first body member 220 via the projection 430 formed on the bearing 400.

Figure 11:
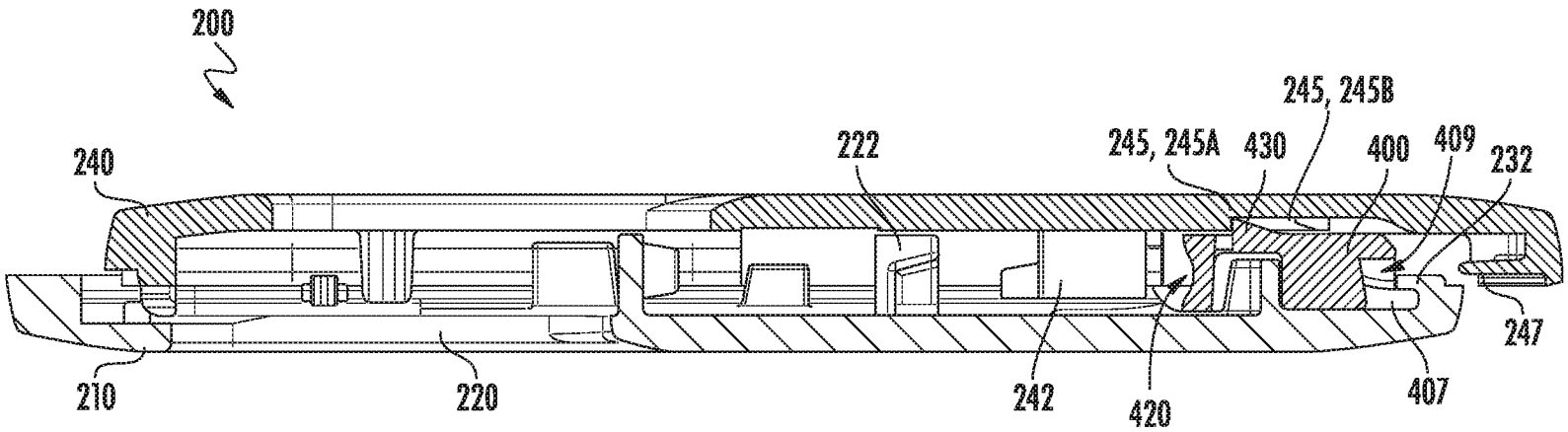
FIG. 11 is a side, cross-sectional view illustrating the tensioner in a first or intermediate position (e.g., with a second body member axially offset relative to a first body member).

Alternatively, referring to FIG. 11, the body 210 of the tensioner 200 such as, for example, the inner surface 241 of the second body member 240 may include first and second latches 246A, 246B (FIG. 4), respectively, for engaging the projection 430 on the bearing 400. As shown, the first and second latches 246A, 246B define first and second recesses 245A, 245B. In use, the first and second recesses 245A, 245B may be axially offset apart. In this manner, the projection 430 formed on the bearing 400 may engage the body 210 of the tensioner 200 (e.g., the second body member 240) in first and second positions depending on whether the projection 430 is placed into engagement with the first recess 245A or the second recess 245B. In use, as shown in FIG. 11, with the projection 430 engaged with the first recess 245A, the tensioner 200 may be assembled with the second body member 240 positioned offset from the first body member 220. Thus arranged, the tensioner 200 can be assembled in a first position, configuration, or state for delivery. Thereafter, during assembly, the operating element 120 can be positioned around the bearing 400, which is already properly positioned and secured within the body 210. Once the operating element 120 has been properly positioned, the second body member 240 can be moved relative to the first body member 220 (e.g., axially moved or slide) so that the projection 430 formed on the bearing 400 engages the second recess 245B formed in the tensioner 200 thereby locking the first and second body members 220, 240 together. This is in contrast to known tensioners wherein a portion of the top half of the tensioner is flexed to separate the body members apart to allow the operating element to be passed therebetween and into the body of the tensioner, and then allow insertion of the bearing after the operating element has been positioned.

By this arrangement, as previously mentioned, the tensioner 200 can be formed with a closed top end 213 for enclosing the bearing 400. The tensioner 200 can be arranged and configured so that the tensioner 200 can be assembly and shipped in a first position (FIG. 11) with the slider 300 and the biasing member 350 coupled to the first body member 220 and with the second body member 240 coupled to, but positioned axially offset from, the first body member 220 so that, during assembly, the operating element 120 can be inserted into the tensioner 200. Thereafter, the second body member 240 can be moved relative to the first body member 220. Once assembled, the bearing 400 can be arranged and configured to prevent the tensioner 200 from disassembly, thus preventing, or at least greatly minimizing, the possibility that the bearing 400 will fall out. That is, by providing a closed top end to capture the bearing 400 and by configuring the tensioner 200 to prevent accidental decoupling, accidental dislodgement of the bearing can be prevented, or at least greatly minimized.

Referring to FIG. 11, an example of a method of assembly will now be disclosed. The tensioner 200 may be provided, shipped, etc. with the bearing 400 positioned in between the first and second body members 220, 240 and with the second body member 240 positioned axially offset relative to the first body member 220 (e.g., the second body member 240 may be coupled to the first body member 220 but positioned in a first, axially offset position). Thereafter, the fabricator may insert the operating element 120 into the openings 215 (FIG. 2) formed in the body 210 and into the groove 420 formed in the bearing 400. Next, the fabricator may move (e.g., axially slide) the second body member 240 relative to the first body member 220 to secure the first and second body members 220, 240 relative to each other. That is, the second body member 240 may be moved relative to the first body member 220 from the first position shown in FIG. 11 to a second or installed position (e.g., such as shown, for example, in FIG. 2). In use, the body 210 of the tensioner 200 may also include a plurality of intermediate projections and recesses 275 (FIG. 4) arranged and configured to interlock with each other in the offset position for preventing decoupling of the first and second body members 220, 240 when in the offset position (FIG. 11).

In one embodiment, the tensioner 200 may be sold along with the architectural-structure covering 100. Alternatively, the tensioner 200 may be sold as a separate item for installation onto an operating element. In one embodiment, it is envisioned that the tensioner 200 may be provided without the bearing 400. In use, the installer may be provided with bearings 400. During installation, the installer opens the body of the tensioner 200 to install the operating element 120 and the bearing 400. Alternatively, as mentioned, the tensioner 200 may be provided with the bearing 400 positioned in between the first and second body members 220, 240 and with the second body member 240 positioned axially offset relative to the first body member 220 as shown in FIG. 11.

The tensioner 200 may be manufactured from any suitable material such as, for example, plastic, metal, etc. For example, in one embodiment, the first and second body members 220, 240 may be molded with a polycarbonate (PC) or a polycarbonate/polyester alloy (PC/PBT), the slider 300 may be molded with a nylon (PA6), and the bearing 400 may be molded with a polyetherimide (PC—"Ultem") or a polyethersulphone (PES). In one embodiment, the bearing 400 is molded with a higher melt temperature plastic to better withstand friction induced heat from the operating element 120 rubbing against it.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of coverings, in addition to the roller-type coverings described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

What is claimed:

1. A tensioner for use with an architectural-structure covering including an operating element, said tensioner selectively securing a position of the operating element relative to the tensioner, said tensioner comprising:

a body having a longitudinal length, a width, a thickness, and a longitudinal axis extending the longitudinal length of the body, the longitudinal length being greater than the width and the thickness, the body including a first body member slidably coupled to a second body member along the longitudinal axis of the body;

a slider movably positioned within said body, said slider movable between first and second positions; and a bearing detachably coupled to said first body member, said bearing including a projection for coupling to said second body member to prevent said second body member from being slidably moved relative to said first body member to prevent decoupling of said second body member from said first body member;

wherein in said first position, said slider adapted to press the operating element against said bearing so that movement of the operating element relative to said body is prevented, and in said second position, said slider is retracted from said bearing so that movement of the operating element relative to the body is permitted.

2. The tensioner of claim 1, wherein said first and second body members include a plurality of interconnecting projections and recesses for slidably coupling said first and second body members to each other.

3. The tensioner of claim 1, further comprising a biasing member for biasing said slider into said first position.

4. The tensioner of claim 3, wherein the biasing member is a coil spring.

5. The tensioner of claim 1, wherein said bearing includes a top surface, a bottom surface, a first end, and a second end, said top surface of said bearing including said projection for engaging a recess formed on a first inner surface of said body so that said first and second body members are prevented from slidably moving relative to each other.

6. The tensioner of claim 5, wherein said projection is a leaf spring.

7. The tensioner of claim 5, further comprising an opening formed in said body, said opening aligned with said projection for providing access thereto.

8. The tensioner of claim 5, wherein the bottom surface of the bearing includes a cavity for receiving a stem formed on a second inner surface of the body.

9. The tensioner of claim 5, wherein said second end of said bearing includes a recess for receiving a lip formed on said body.

10. The tensioner of claim 5, wherein said first end of said bearing includes a groove for contacting the operating element.

11. The tensioner of claim 1, wherein, when said slider is retracted, said slider does not contact said operating element.

12. The tensioner of claim 1, wherein said first and second body members each include a wall portion extending from an inner surface thereof so that when the second body member is coupled to the first body member, a top end of the body includes a closed surface formed by said wall portions for enclosing said bearing within said body.

13. A tensioner for use with an architectural-structure covering including an operating element, said tensioner selectively securing a position of the operating element relative to the tensioner, said tensioner comprising:

a body having a longitudinal length, a width, a thickness, and a longitudinal axis extending the longitudinal length of the body, the longitudinal length being greater than the width and the thickness, the body including a first body member slidably coupled to a second body member along the longitudinal axis of the body;

a slider movably positioned within said body, said slider movable between first and second positions; and a bearing positioned within said body, the bearing detachably coupled to the body, the bearing coupling said second body member to said first body member and being arranged and configured to prevent decoupling of said second body member from said first body member;

wherein in said first position, said slider adapted to press the operating element against said bearing so that movement of the operating element relative to said body is prevented, and in said second position, said slider is retracted from said bearing so that movement of the operating element relative to the body is permitted; and wherein said first and second body members each includes a wall portion extending from an inner surface thereof so that when the second body member is coupled to the first body member, a top end of the body includes a closed surface formed by said wall portions for enclosing said bearing within said body.

14. The tensioner of claim 13, wherein the bearing includes a projection for coupling to said second body member to prevent said second body member from being decoupled from said first body member.

15. The tensioner of claim 14, wherein said bearing includes a top surface, a bottom surface, a first end, and a second end, said top surface of said bearing including said projection for engaging a recess formed on a first inner surface of said body so that said first and second body members are prevented from moving relative to each other.

16. The tensioner of claim 15, wherein said projection is a leaf spring.

17. The tensioner of claim 15, further comprising an opening formed in said body, said opening aligned with said projection for providing access thereto.

18. The tensioner of claim 15, wherein the bottom surface of the bearing includes a cavity for receiving a stem formed on a second inner surface of the body.

19. The tensioner of claim 15, wherein said second end of said bearing includes a recess for receiving a lip formed on said body.

20. The tensioner of claim 15, wherein said first end of said bearing includes a groove for contacting the operating element.

21. The tensioner of claim 13, wherein, when said slider is retracted, said slider does not contact said operating element.

22. The tensioner of claim 13, wherein said first and second body members include a plurality of interconnecting projections and recesses for slidably coupling said first and second body members to each other.

23. The tensioner of claim 13, further comprising a biasing member for biasing said slider into said first position.

* * * * *